US006301737B1

(12) United States Patent
Morse

(10) Patent No.: US 6,301,737 B1
(45) Date of Patent: Oct. 16, 2001

(54) HYDRODYNAMIC POOL BRUSH ASSEMBLY

(76) Inventor: Kevin Morse, 1031 Briarcliff Dr., La Habra, CA (US) 90631

( * ) Notice: Subject to any disclaimer, the term of this patent is extended or adjusted under 35 U.S.C. 154(b) by 0 days.

(21) Appl. No.: 09/534,607

(22) Filed: Mar. 27, 2000

(51) Int. Cl.[7] ..... E04H 4/16
(52) U.S. Cl. ..... 15/1.7; 15/246
(58) Field of Search ..... 15/1.7, 246

(56) References Cited

U.S. PATENT DOCUMENTS

| | | | | |
|---|---|---|---|---|
| 2,243,576 | | 5/1941 | Otto | 15/1.7 X |
| 3,402,413 | * | 9/1968 | Gibellina | 15/1.7 |
| 4,637,087 | | 1/1987 | Feinberg | 15/1.7 |
| 4,733,427 | | 3/1988 | Conrad | 15/1.7 X |
| 4,742,592 | * | 5/1988 | Addona, Sr. | 15/1.7 |
| 4,783,868 | | 11/1988 | O'Callaghan | 15/1.7 |
| 4,909,173 | | 3/1990 | Strong | 15/1.7 X |
| 4,962,558 | | 10/1990 | Harrell, Jr. | 15/1.7 |
| 5,539,947 | | 7/1996 | Kiraly | 15/1.7 |
| 5,864,917 | | 2/1999 | Landsman | 15/246 |
| 5,983,431 | | 11/1999 | Meshulan | 15/1.7 |

* cited by examiner

*Primary Examiner*—Mark Spisich
(74) *Attorney, Agent, or Firm*—Edgar W. Averill, Jr.

(57) ABSTRACT

A hydrodynamic attachment for use with a pool brush having scrubbing bristles at a brush head portion connected to an elongated pole. The hydrodynamic attachment has a base fin connected to the pool brush opposite the scrubbing bristles, and an outer fin connected to the base fin to form a scoop pocket. The scoop pocket has a generally C-shaped cross-section such that the scoop pocket can temporally trap water when the pool brush is pushed in a downward motion. In this manner a transverse force is produced against the brush head which is then urged toward the target surface of a pool. Additionally, an improved pool brush which incorporates the hydrodynamic attachment is disclosed.

12 Claims, 2 Drawing Sheets

12
11
A
13
10
B
15
16
26
19
17
20
22'
12
23
18'
23
18
15
16

HYDRODYNAMIC POOL BRUSH ASSEMBLY

BACKGROUND OF THE INVENTION

The field of the invention pertains to cleaning brushes. The invention relates more particularly to a pool brush attachment which is specially adapted to produce a hydrodynamic, transverse scrubbing force on a brush head portion of the pool brush when cleaning the surfaces of a water-filled pool.

Pool brushes have been utilized for cleaning algae, dirt, and debris accumulated on the walls and floor surfaces of pools. Pool brushes typically have a brush head portion transversely secured to a long pole or handle. However, due to the depth and span of most pools, it is oftentimes arduous and difficult to apply a transverse scrubbing force on the brush portion for proper and adequate cleaning of a pool surface. Moreover, the difficulty is greatly compounded because of the precarious nature of standing at the edge of a pool when cleaning.

To remedy this problem and facilitate cleaning of pool surfaces, various devices have been developed with hydrodynamic wings, planes, and other means to produce transverse thrust forces at the brush portion of a pool brush.

Many such prior art devices utilize a pivot mechanism which produces a hydrodynamic transverse force on a brush head during both the upward and downward strokes. For example, in U.S. Pat. Nos. 2,243,576, 4,909,173, and 5,864,917, vane components are shown pivotally held on either the brush head or the elongated handle of a cleaning brush. Each of the vanes function to pivot about a pivot axis which is normal to the direction of motion when reciprocating between upward and downward strokes. And in particular, the vanes in all the aforementioned prior art patents pivot away from the direction of motion. However, forcing a pool brush against a wall during its upward return stroke is not necessarily a desirable feature for pool cleaning purposes. The upward return stroke does not accomplish the purpose of the brushing of the pool walls, i.e. to move dirt and debris down and away from the walls, and toward the drain at the bottom of the pool.

Additionally, prior art pool brush attachments have also utilized stationary or "fixed" attachment designs to produce transverse forces against the brush head. For example, in U.S. Pat. No. 5,983,431, an attachment for a pool brush is shown having a hydrofoil with an upstanding fin fixedly connected to a base portion at approximately a right angle thereto. Flow apertures along the upstanding fin operate together with the angular configuration of the upstanding fin and base portion to produce a transverse force when the pool brush is pushed in a downward motion. Furthermore, in U.S. Pat. No. 3,402,413, a pool brush guide is shown having a force surface 40 fixedly extending from a guide surface 30 at a trailing end. Additionally a leading edge surface 32, is fixedly connected to the guide surface 30 at a front edge 33. Similar to the '431 patent, the configuration in the '413 patent also produces a transverse force on the brush portion when the pool brush is pushed in a downward motion without necessarily producing a transverse force during the upward stroke.

The disadvantage of the '431 and '413 patents (as well as the '576, '173, and '917 patents) is that their design configurations may not produce an adequate transverse force suitable for facilitated pool scrubbing. This is especially true for the '431 patent because water flow is not impeded or redirected in a direct manner against an attack, or otherwise direct contact, surface. The upstanding fin, notwithstanding its name, does not stand directly in the path of fluid flow to produce the transverse force. Moreover, while the pool brush guide in the '413 patent utilizes a force surface 40 to directly impede and redirect fluid flow for producing a transverse force, this design may not impede water sufficiently to produce the required transverse force to remove tough dirt and debris. This is also true for the pivotally angled vents of the '576, '173, and '917 patents. With these prior art attachments and devices, an exceedingly arduous amount of downward force may be necessary to exert a proportionally useful transverse scrubbing force against the pool surface.

BRIEF SUMMARY OF THE INVENTION

It is an object of the present invention to provide a simple and cost-effective hydrodynamic attachment to a cleaning brush, particularly a pool brush, capable of exerting a transverse force on a brush portion of the cleaning brush against a submerged surface when the brush is moved in a downward motion, for effectively and adequately scrubbing the submerged surface.

It is a further object of the present invention to provide a hydrodynamic attachment to a pool brush which is fixedly secured to the pool brush without any moving parts.

It is a still further object of the present invention to provide a simple, one-piece hydrodynamic attachment to a pool brush which is light weight and extremely durable in operation.

It is a still further object of the present invention to provide an improved pool brush having a hydrodynamic attachment capable of exerting a transverse force on a brush portion of the pool brush against a submerged pool surface, for effectively and adequately scrubbing the submerged pool surface.

The present invention is for a hydrodynamic attachment for use with a pool brush of the type having an elongated pole with a handle end and a brush end, and a brush head connected to the elongated pole at the brush end. Furthermore, the pool brush has scrubbing means extending from the brush end for cleaning a target surface of a pool. The hydrodynamic attachment has a base fin adapted to be connected by fastening means to the pool brush at the brush end opposite the scrubbing means. Additionally, the attachment has an outer fin connected to the base fin to form a scoop pocket having a generally C-shaped cross-section. The scoop pocket is capable of temporally trapping water when the elongated pole is pushed in a downward motion. In this manner the brush head is urged toward the target surface of the pool. Furthermore, the present invention is for an improved pool brush incorporating the hydrodynamic attachment discussed above.

DETAILED DESCRIPTION OF THE PREFERRED EMBODIMENTS

Figure 1:
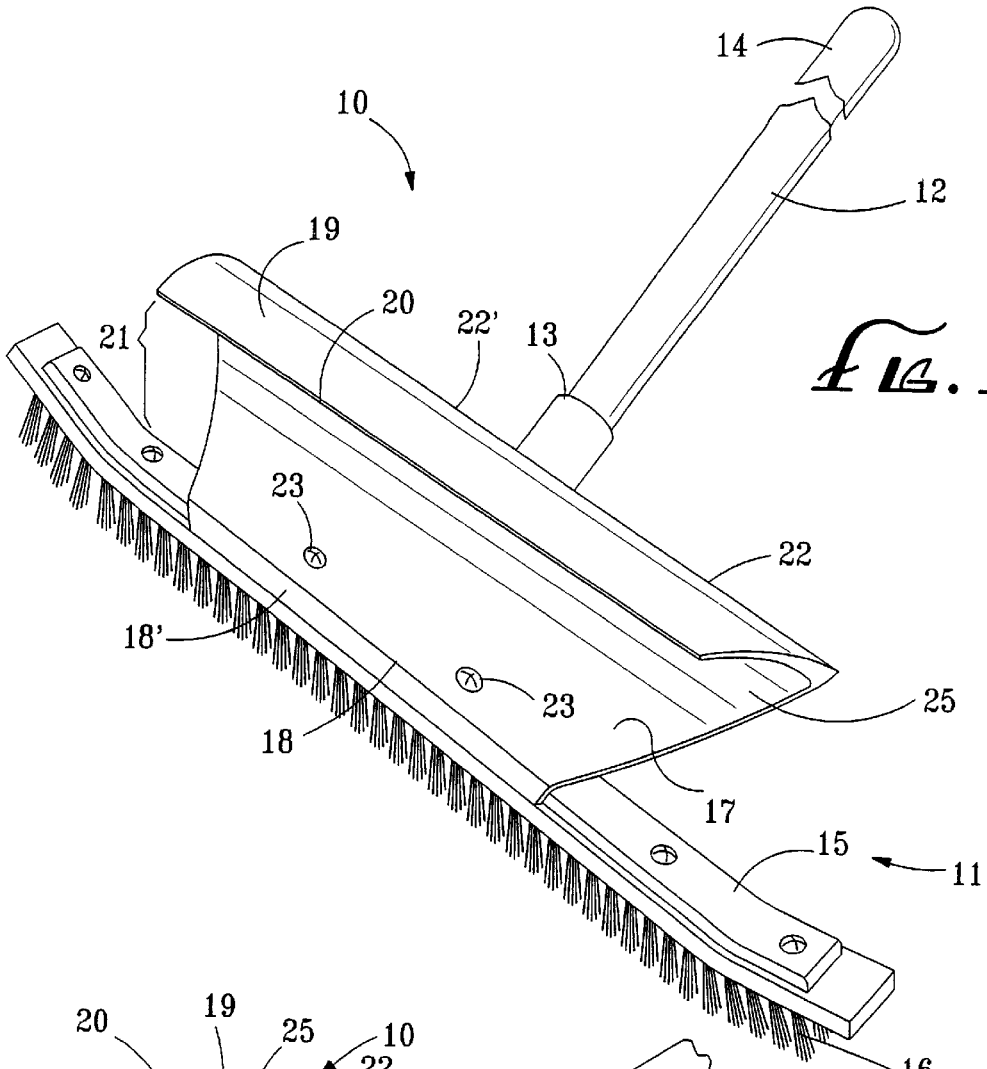
FIG. 1 is a perspective view of the hydrodynamic pool brush attachment secured to a pool brush.

Referring now to the drawings, FIGS. 1–4 show the hydrodynamic pool brush attachment, generally indicated at reference character 10, as it is secured to and utilized in association with a pool brush, generally indicated at reference character 11. As can be seen in the figures, the pool brush 11 is of a type commonly utilized for pool cleaning and maintenance. In this regard, the pool brush 11 has a brush head 15 having scrubbing means, such as bristles 16, which extend therefrom, and an elongated pole 12 having a brush end 13 and a handle end 14. The brush head 15 is connected to the elongated pole 12 at the brush end 13 in a manner known in the relevant art. As can be best seen in FIG. 2, the conventional pool brush head 15 is connected at an angle to the brush end 13 of the elongated pole 12 such that the bristles 16 extend away from the brush end 13 at the same angle.

Figure 2:
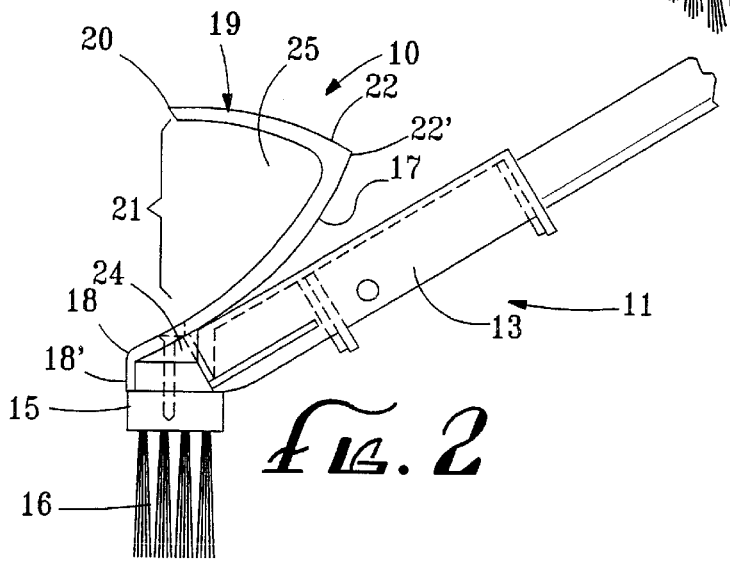
FIG. 2 is a side view of the hydrodynamic pool brush attachment secured to a pool brush.
Figures 3, 4:
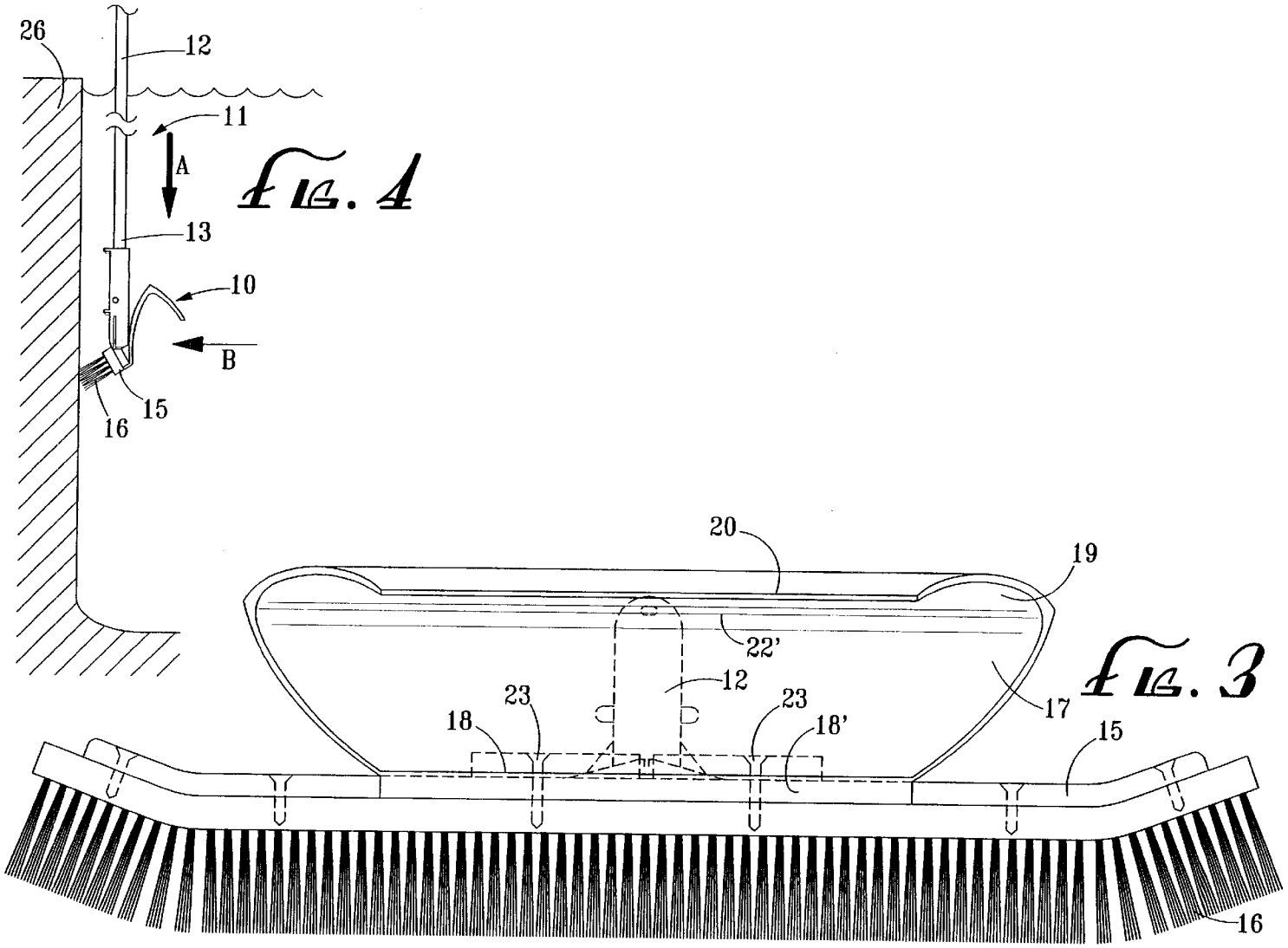
FIG. 3 is a front view taken along the line 3—3 of FIG. 1, showing the hydrodynamic pool brush attachment secured to a pool brush.
FIG. 4 is a dynamic side view of the hydrodynamic pool brush attachment in operation while secured to a pool brush, and illustrating the transverse force produced in a pool.

As can be best seen in FIGS. 1—3, the hydrodynamic attachment 10 includes a base fin 17 adapted to be connected to the surface of the brush head 15 opposite the bristles 16 by fastener means. The fastener means may be embodied either as conventional screws 23, or by integral formation of the base fin 17 to the brush head 15. Alternatively, the attachment 10 may be secured to the brush end 13 of the elongated pole 12 by suitable mounting means (not shown) and sufficiently proximate to the brush head 15. As can be seen in FIG. 2, the base fin 17 preferably includes a wedge portion 24 integrally formed on the underside thereof, which sits flush against the brush head 15 to better support the screws 23 and the hydrodynamic attachment 10 overall. Furthermore, the attachment 10 includes an outer fin 19 connected to the base fin 17 at a trailing end 22. The base fin 17 and the outer fin 19 are preferably integrally formed and connected at the trailing end 22. Moreover, the trailing end 22 is preferably tapered, and preferably still, tapered to a pointed edge 22'.

As can be best seen in FIG. 2, the base and outer fins 17, 19 together form a scoop pocket 25 having a generally C-shaped configuration. Preferably, the base and outer fins 17, 19 are concavedly curvilinear relative to each other to form the generally C-shaped configuration of the scoop pocket 25. However, it is not limited only to such. The term "generally C-shaped configuration" is hereby defined and used in the claims to mean a shape having two extensions joined at a common end, and which extensions coextend substantially adjacent each other. FIG. 2 also illustrates the difference in breadths of the respective outer and base fins 19, 17. The term "breadth" defined herein and in the claims refers to the distances from the respective leading edges 20, 18 to the trailing edge 22'. As can be seen in FIG. 2, the breadth of the outer fin 19 is substantially less than the breadth of the base fin 17. And preferably, the outer fin 19 is about half the breadth of the base fin 17. This difference operates to produce the hydrodynamic transverse force, as will be discussed in detail below.

The scoop pocket 25 is accessible via a mouth opening 21 between an outer leading edge 20 and a base leading edge 18 of the outer and base fins 19 and 17, respectively. Furthermore, the base leading edge 18 has a base lip 18' which preferably hangs over the front edge of the brush head 15. As shown in FIG. 4, the mouth opening 21 faces and opens in a downward direction when the pool brush 11 is vertically positioned as shown for scrubbing of a pool wall 26. And as can be seen in FIG. 3, showing a front view of the pool brush 11 and the attachment 10, the mouth opening 21 allows direct access of fluid, i.e. water, into the scoop pocket 25.

In this manner, and once the hydrodynamic attachment 10 is connected and secured to the pool brush 12 as shown in the figures, the downward movement of the pool brush 12 in the direction of arrow A in FIG. 4, will have the effect of impeding and temporally trapping water in the scoop pocket 25 before it escapes out through the sides and over the outer leading edge 20 of the hydrodynamic attachment 10. While not wishing to be bound by any theory, it is believed that during the transitory period in which it is thus trapped, the water will exert a greater force on the greater breadth and area of the base fin 17, than on the outer fin 19. The net effect of the breadth differential results in the production of the transverse force on the brush head 15. And consequently, the transverse force then operates to continuously urge the brush head 15 toward the adjacent target pool wall 26, as indicated by arrow B in FIG. 4, when moved in a downward direction (arrow A).

Additionally, as can be best seen in FIGS. 2 and 3, the hydrodynamic attachment 10 has a low profile when attached to the pool brush 11. This enables the attachment 10 to effectively reach inside skimmers, pool steps integrally formed and inset into pool walls, and any other low clearance area or space. The prior art devices disclosed in U.S. Pat. Nos. 3,402,413, 4,909,173, 2,243,576, and 5,864,917, however, would not be able to fit into such spaces. Moreover, the prior art patents disclosing a pivot mechanism would be particularly difficult to operate in tight conditions and environments due to the radial area necessary for proper operation.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A hydrodynamic attachment for use with a pool brush of the type having an elongated pole with a handle end and a brush end, and a brush head connected to said elongated pole at the brush end, said brush head having scrubbing means extending therefrom for cleaning a target surface of a pool, said hydrodynamic attachment comprising:

a base fin adapted to be connected by fastening means to said pool brush at said brush end opposite said scrubbing means; and an outer fin connected to said base fin to form a scoop pocket therewith, said scoop pocket having a generally C-shaped cross-section for temporally trapping water therein when said elongated pole is pushed in a downward motion to thereby urge said brush head toward said target surface of said pool.

2. The hydrodynamic attachment as in claim 1, wherein said outer fin has a breadth less than a breadth of said base fin.

3. The hydrodynamic attachment as in claim 2, wherein the breadth of said outer fin is one-half the breadth of said base fin.

4. The hydrodynamic attachment as in claim 1, wherein said base and outer fins are connected to form a tapered trailing end.

5. The hydrodynamic attachment as in claim 4, wherein said tapered trailing end extends to a pointed edge.

6. The hydrodynamic attachment as in claim 1, wherein said base and outer fins are concavedly curvilinear relative to each other.

7. An improved pool brush for cleaning a target surface of a pool, said pool brush of the type having an elongated pole with a handle end and a brush end, and a brush head connected to said elongated pole at the brush end, said brush head having scrubbing means extending therefrom, said improvement comprising:

a hydrodynamic attachment having a base fin adapted to be connected by fastening means to said pool brush at said brush end opposite said scrubbing means, and an outer fin connected to said base fin to form a scoop pocket therewith, said scoop pocket having a generally C-shaped cross-section for temporally trapping water therein when said elongated pole is pushed in a downward motion to thereby urge said brush head toward said target surface of said pool.

8. The improved pool brush as in claim 7, wherein said outer fin has a breadth less than a breadth of said base fin.

9. The improved pool brush as in claim 8, wherein the breadth of said outer fin is one-half the breadth of said base fin.

10. The improved pool brush as in claim 7, wherein said base and outer fins are connected to form a tapered trailing end.

11. The hydrodynamic attachment as in claim 10, wherein said tapered trailing end extends to a pointed edge.

12. The improved pool brush as in claim 7, wherein said base and outer fins are concavedly curvilinear relative to each other.

* * * * *